US010804053B2

(12) United States Patent
Li et al.

(10) Patent No.: US 10,804,053 B2
(45) Date of Patent: Oct. 13, 2020

(54) CIRCUIT BREAKER HANDLE CONNECTION STRUCTURE

(71) Applicant: SHANGHAI LIANGXIN ELECTRICAL CO., LTD, Shanghai (CN)

(72) Inventors: Qiang Li, Shanghai (CN); Wushan Jiang, Shanghai (CN); Zhicao Liu, Shanghai (CN); Yipeng Yu, Shanghai (CN); Jihong Ju, Shanghai (CN)

(73) Assignee: SHANGHAI LIANGXIN ELECTRICAL CO., LTD, Shanghai (CN)

( * ) Notice: Subject to any disclaimer, the term of this patent is extended or adjusted under 35 U.S.C. 154(b) by 0 days.

(21) Appl. No.: 16/348,196

(22) PCT Filed: Aug. 9, 2018

(86) PCT No.: PCT/CN2018/099645

§ 371 (c)(1),
(2) Date: May 8, 2019

(87) PCT Pub. No.: WO2019/062344

PCT Pub. Date: Apr. 4, 2019

(65) Prior Publication Data

US 2019/0267201 A1 Aug. 29, 2019

(30) Foreign Application Priority Data

Sep. 27, 2017 (CN) ..... 2017 1 0892192

(51) Int. Cl.
*H01H 21/22* (2006.01)
*H01H 71/52* (2006.01)
*H01H 71/02* (2006.01)
*H01H 71/10* (2006.01)

(52) U.S. Cl.
CPC ..... *H01H 21/22* (2013.01); *H01H 71/0207* (2013.01); *H01H 71/10* (2013.01); *H01H 71/52* (2013.01); *H01H 71/521* (2013.01)

(58) Field of Classification Search
CPC ..... H01H 71/56; H01H 71/521; H01H 3/06; H01H 3/10; H01H 21/22
See application file for complete search history.

(56) References Cited

U.S. PATENT DOCUMENTS 9,165,730 B2 * 10/2015 Bunk ..... H01H 21/22

FOREIGN PATENT DOCUMENTS

| | | | |
|---|---|---|---|
| CN | 103065892 | A | 4/2013 |
| CN | 204303714 | U | 4/2015 |
| CN | 107845549 | A | 3/2018 |
| JP | 2007305310 | A | 11/2007 |

* cited by examiner

*Primary Examiner* — Vanessa Girardi
(74) *Attorney, Agent, or Firm* — IPro, PLLC

(57) ABSTRACT

A circuit breaker handle connection structure, comprising a handle (1) and a lever (2), the handle (1) and the lever (2) being assembled together. The bottom of a handle disc portion (101) of the handle (1) is provided with a mounting recess (102); the bottom (201) of the lever (2) is mounted in the mounting recess (102) and can rotate; when the lever (2) rotates to a fixed position in the mounting recess (102), the degree of freedom is limited by limiting bosses (103).

10 Claims, 5 Drawing Sheets

CIRCUIT BREAKER HANDLE CONNECTION STRUCTURE

TECHNICAL FIELD

The present invention relates to the technical field of circuit breaker, and particularly relates to a circuit breaker handle connection mode.

BACKGROUND

A circuit breaker is classified as a high-voltage circuit breaker and a low-voltage circuit breaker according to its usage range. A low-voltage circuit breaker is also called an automatic switch, what is commonly named as an "air switch" also refers to a low-voltage circuit breaker, it is an electric device which plays a role of a manual switch, also can automatically perform pressure loss, undervoltage, overload and short circuit protection. It can be used to distribute electrical energy, not frequently start an asynchronous motor, provide protection for a power line and a motor, etc., can automatically cut off a circuit when they have faults such as serious overload or short circuit and under-voltage, etc., its function is equivalent to combination of a fuse type switch and an over-under-heating relay, etc., and generally does not need to change components after fault current is cut off, obtains a wide application.

A circuit breaker usually uses a handle and a lever as a control part of an operating device to control On and Off of the circuit breaker, in an existing circuit breaker, connection of the handle and the lever is usually finished by vertical mounting through cooperation between at least one hole with round shape or other shapes such or rectangle of the lever and stretching bosses at corresponding position which have a round shape or other shapes such or rectangle located on the handle; or like a plastic-shell circuit breaker buckle cover with a handle which is located in the center as disclosed in a China patent ZL201110005746.8, comprising a large cover, a turning cover, a handle and a lever, the lever is in an inverted U shape, its bottom extends outwards to protrude; the handle is in a flaky arc shape, its arc top extends out of the handle part in a radial direction, at least one L-shaped or U-shaped guide rail extending in an axial direction of the arc is arranged in inner side of the arc; the protrusion on the lever can slide relatively to the guide rail of the handle. After assembly, movement of the handle in the tangential direction of the arc of the handle is very small, the handle can slide relatively to the lever along the axis of the protrusion towards the center of the large cover, so that the stalk-part of the handle is located in the center of the large cover along the direction, the arc surface of the handle is located between an insulating partition plate of the large cover and a shielding plate, the lever and the handle and the large cover are connected into a whole, fastening of the base and the large cover is easy. An operation hole of the turning cover is located in the center of the turning cover, after the turning cover is connected with the large cover, the stalk part of the handle is located in the center of the buckle cover of the whole plastic shell circuit breaker, operation is more convenient, visual sense is more attractive. However, in the existing mounting modes of a handle and a lever, when the handle is vertically mounted, when the handle drives the lever to open and close the breaker, the handle needs an arc inside the center cover of the circuit breaker to limit position, first, the operation force of the handle can be increased, the movement speed of the mechanism can be influenced, second, friction between the handle and the center cover can be caused in the process of opening and closing the breaker, and a large amount of dust influencing mechanism movement components can be generated; third, production debugging is not convenient, without a center cover, the handle cannot be reliably connected with the lever, and can easily fall off from the lever, even can't open and close the breaker, in the process of production debugging, other tools are needed to help to realize closing and opening actions of products. When the handle is mounted from a side surface, position limit of the handle is insufficient, one side is in a full-opening state, very easy to slide out from the limiting-position recess or generate friction with the side wall of the center cover during process of using, a lot of dust can be caused in the same way, the usability of the product is influenced.

SUMMARY

As to technical defects in the existing connection mode of a circuit breaker handle and a lever, the present invention provides a circuit breaker handle connection structure, to change traditional directly-mounting mode for a lever and a handle as an mounting mode using rotation for the lever and the handle, the handle can be reliably connected with the lever and the position is limited under the condition that the cost of the handle and the lever is not increased.

Technical Scheme

In order to achieve the above technical purpose, the present invention designs a circuit breaker handle connection mode, comprising: a handle and a lever, the handle and the lever are mounted together, which is characterized in that a mounting recess is arranged in a bottom of the handle disc portion of the handle, a bottom of the lever is mounted in the mounting recess and can rotate, when the lever rotates to a fixed position in the mounting recess, the degrees of freedom are limited by a limiting-position boss to enable it to be mounted in the mounting recess.

Further, when the lever rotates to a fixed position in the mounting recess, the degrees of freedom are limited by the limiting-position boss and a limiting-position buckle so that it is fixedly mounted in the mounting recess.

Further, the bottom of the lever outstretches a positioning boss, when the lever rotates to a fixed position in the mounting recess, the degrees of freedom of the positioning boss are limited by the limiting-position boss to enable it to be mounted in the mounting recess.

Further, the limiting-position boss comprises a limiting-position transverse boss, the limiting-position transverse boss extends from outer side end surface of the recess wall of the mounting recess to inside of the recess, the limiting-position transverse boss stretches a limiting vertical boss to the bottom of the mounting recess, the limiting-position buckle is arranged on the outer side end surface of the recess wall of the mounting recess, an end of the limiting-position buckle is arranged on the end surface of the outer side of the recess wall of the mounting recess, another end can generate deformation, when the lever is located at a fixed position, the end of the limiting-position buckle which generates deformation resists against side wall of the lever so that it cannot rotate.

Preferably, the number of the limiting-position bosses are two, they are symmetrically arranged on outer side end surface of the recess wall of the mounting recess.

Preferably, the number of the limiting-position buckles are two, they are symmetrically arranged on outer side end surface of the recess wall of the mounting recess.

Preferably, the number of the positioning bosses are two, they are symmetrically arranged at two side ends of the bottom of the lever.

Preferably, the lever is in a U shape.

Further, there is a gap between the end of the limiting-position buckle which generates deformation and the end surface of the outer side of the recess wall of the mounting recess.

Beneficial Effect

The present invention provides a circuit breaker handle connection mode, a rotary mounting mode is used for the lever and the handle, the handle can be reliably connected with the lever and the position is limited while cost of the handle and the lever is not increased. Normal movement is enabled without relying on a center cover which is used to achieve limiting position for the handle, so that production debugging of a circuit breaker is more convenient, safer and more reliable in the process of using. Compared with a transverse mounting mode, it is more reliable to limit position after the handle is assembled, structure space does not need to be reserved for mounting the handle.

DETAILED DESCRIPTION

The present invention is further described below with reference to the accompanying drawings and embodiments.

Figure 1:
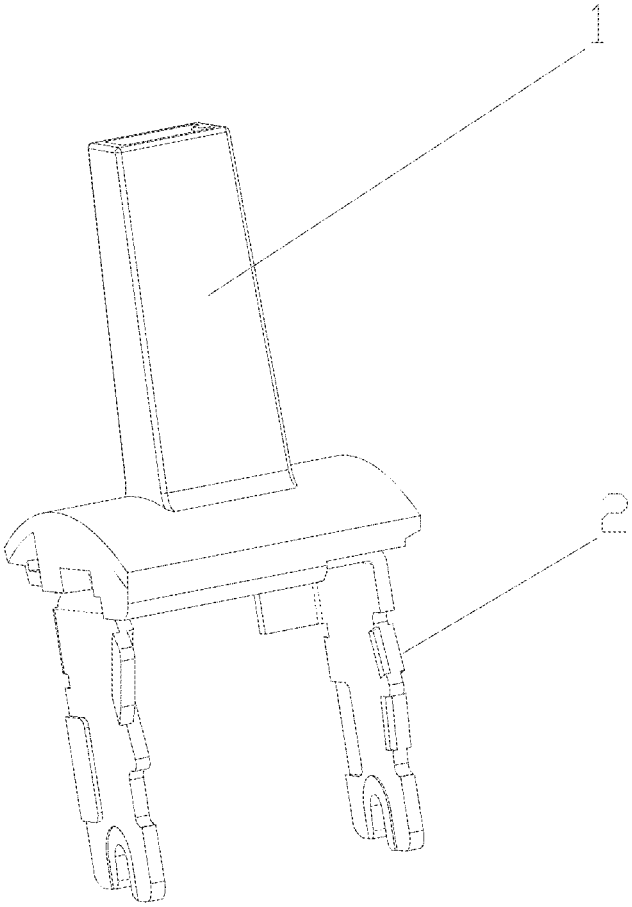
FIG. 1 is a schematic structural diagram of an embodiment of the present invention.

FIG. 1 shows a circuit breaker handle connection mode, comprising a handle 1 and a lever 2, in the embodiment, the lever 2 is in a U shape. The handle 1 and the lever 2 are assembled together, here, a mounting recess 102 is arranged at a bottom of a handle disc portion 101 of the handle 1, a bottom 201 of the lever 2 is mounted in the mounting recess 102 and can rotate, the bottom of the lever 2 outstretches a positioning boss 202, when the lever 2 rotates to a fixed position in the mounting recess 102, the degrees of freedom of the positioning boss 202 are limited by a limiting-position boss 103 so that it is mounted in the mounting recess 102. Further, a limiting-position buckle 104 can be additionally arranged to further limit the degrees of freedom so that it can be fixedly mounted in the mounting recess 102. In the embodiment, the number of the limiting-position bosses 103 is two, they are symmetrically arranged on outer side end surface of recess wall of the mounting recess 102. The number of the limiting-position buckles 104 are two, they are symmetrically arranged on the outer side end surface of the recess wall of the mounting recess 102.

Figure 2:
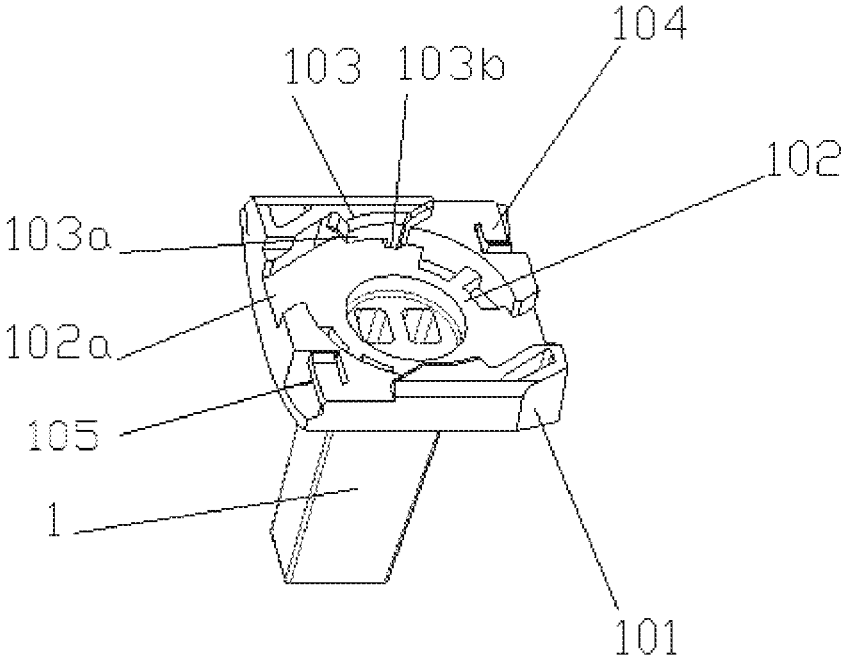
FIG. 2 is a schematic structural diagram of a handle in an embodiment of the present invention.
Figure 3:
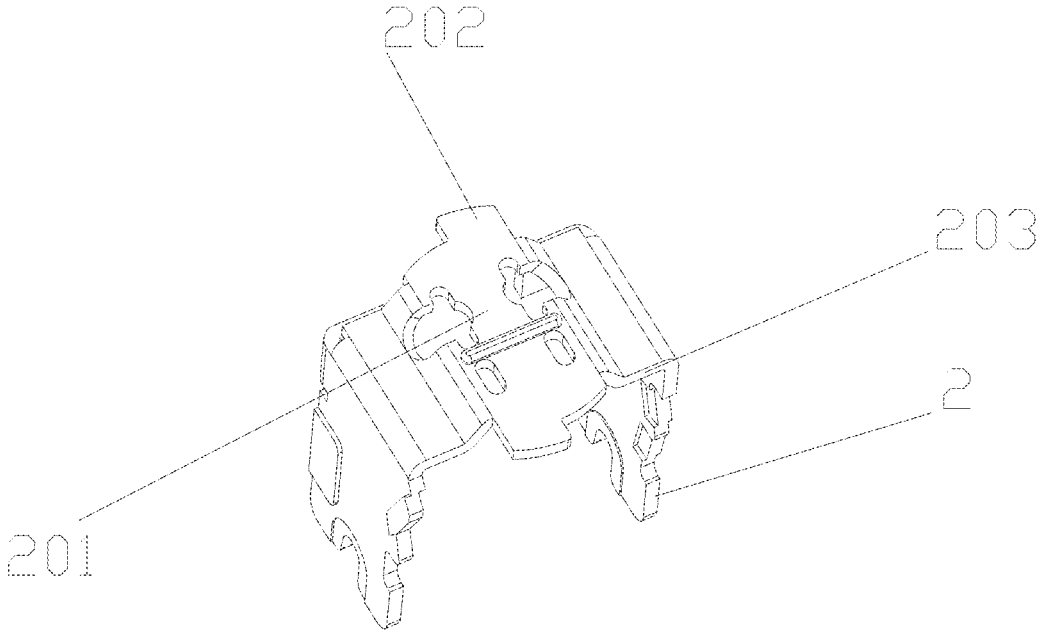
FIG. 3 is a schematic structural diagram of a lever in an embodiment of the present invention.

As shown in FIG. 2, the limiting-position boss 103 comprises a limiting-position transverse boss 103*a*, the limiting-position transverse boss 103*a* extends from the outer side end surface of the recess wall of the mounting recess 102 to the inside of the recess, the limiting-position transverse boss 103*a* outstretches a limiting-position vertical boss 103*b* to a bottom of the mounting recess 102, when a bottom 201 of the lever 2 rotates to a fixed position in the mounting recess 102, the positioning boss 202 is inserted into a space formed by the limiting-position transverse boss 103*a*, the limiting-position vertical boss 103*b* and the bottom surface of the mounting recess 102, so that the lever 2 is fixedly mounted in the mounting recess 102.

As shown in FIG. 2, the limiting-position buckle 104 is arranged on the outer side end surface of the recess wall of the mounting recess 102, an end of the limiting-position buckle 104 is arranged on the end surface of the outer side of the recess wall of the mounting recess 102, there is a gap 105 between another end and the end surface of the outer side of the recess wall of the mounting recess 102 so that deformation can be generated, when the lever 2 is located at a fixed position, the end of the limiting-position buckle 104 which generates deformation resists against the side wall 203 of the lever 2 so that it cannot rotate back.

Figure 4:
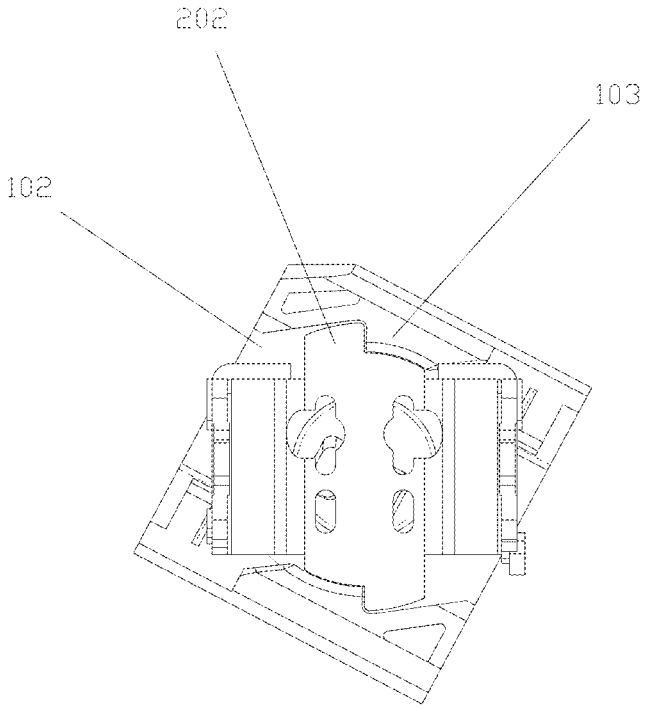
FIG. 4 is a schematic structural diagram of an initial state of a lever being mounted in a handle in an embodiment of the present invention.
Figure 5:
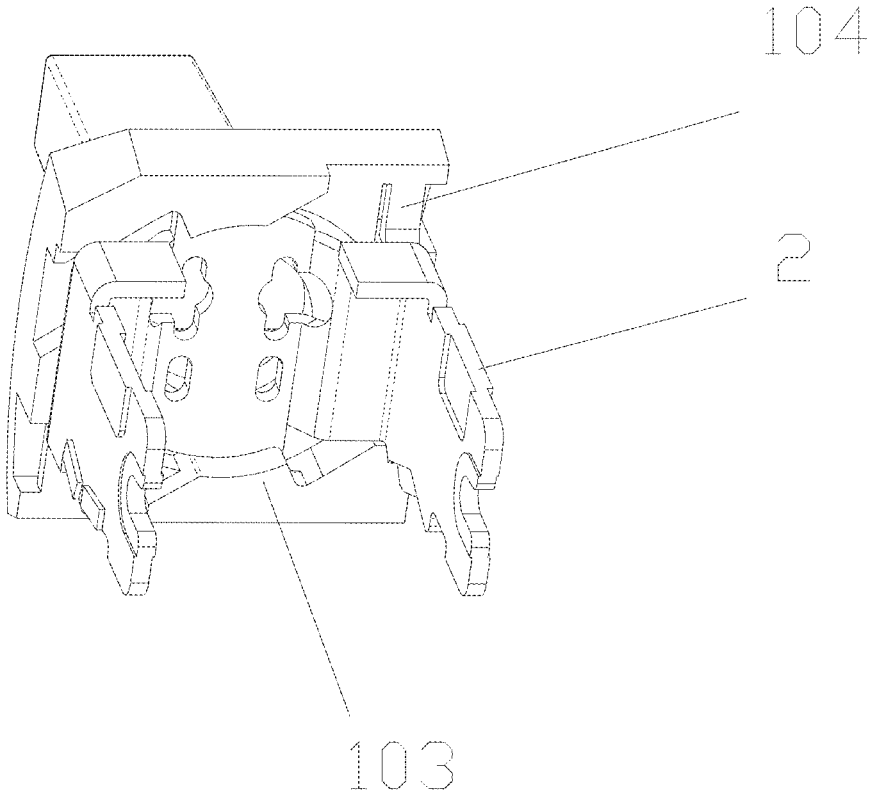
FIG. 5 is a schematic structural diagram of a lever being mounted in a handle and being located at a fixed position in an embodiment of the present invention.

As shown in FIG. 4, first, the lever 2 is inserted into the mounting recess 102, then the lever 2 is rotated, during the process when the lever 2 is rotating, the lever 2 presses the limiting-position buckle 104 downwards so that it can't resist the rotation of the lever 2, as shown in FIG. 5, when the positioning boss 202 of the lever 2 rotates so that it is resisted against by the limiting-position transverse boss 103*a* and the limiting-position vertical boss 103*b*, the degrees of freedom of reverse rotation of the lever 2 can be limited by the limiting-position buckle 104 which is bounced and restored to an original position, the position where the lever 2 is located now is a fixed position, in the embodiment, the number of the positioning bosses 202 are two, they are symmetrically arranged at the two side ends of the bottom of the lever 2, so that reliable mounting between the lever and the handle can be better ensured.

The structures, proportions, sizes, etc. shown in the accompanying figures are only used to be referred to illustrate the content disclosed in the specification, so that people who are familiar with the technology can understand and read, not used for limiting conditions under which the present invention can be implemented, so that don't have technical significance, any modification of structure, change of proportional relation, adjustment of size, should fall within the scope of the technical content disclosed by the present invention under the condition that the functional effect and the purpose of the present invention which can be achieved is not affected. Meanwhile, terms such as "upper", "lower" "left", "right", "center", "clockwise", "counter-clockwise", etc. cited in the specification, is just for clear description, not intended to limit the scope of the present invention, the change or adjustment of its relative relation, should be regarded as the scope which can be implemented by the invention, under the condition that the technical content is not essentially changed.

What is claimed is:

1. A circuit breaker handle connection structure, comprising a handle and a lever, wherein the handle comprises a handle disc portion, the handle disc portion comprising a mounting recess and a limiting-position boss;

wherein the mounting recess is configured to receive a bottom of the lever along an axis;

wherein the lever is rotatable about the axis while the bottom is in the mounting recess;

wherein the limiting-position boss is configured to limit rotation of the lever about the axis while the bottom is in the mounting recess; and wherein the limiting-position boss is configured to prevent removal of the lever from the handle along the axis after the lever is rotated about the axis while the bottom is in the mounting recess.

2. The circuit breaker handle connection structure claim 1, wherein the limiting-position boss comprises a limiting-position transverse boss and a limiting-position vertical boss;

wherein the limiting-position transverse boss extends radially toward the axis and extends into and over the mounting recess, and the limiting-position vertical boss extends along the axis between the limiting-position transverse boss and a bottom of the mounting recess.

3. The circuit breaker handle connection structure of claim 1, wherein the limiting-position boss comprises two members that are rotationally symmetric about the axis.

4. The circuit breaker handle connection structure of claim 1, wherein the lever is in a U shape.

5. The circuit breaker handle connection structure of claim 1, wherein the bottom of the lever comprises a positioning boss that extends radially from the axis;

wherein the positioning boss is configured to engage the limiting-position boss, after the rotation of the lever about the axis.

6. The circuit breaker handle connection structure of claim 5, wherein the positioning boss comprises two members that are rotationally symmetric about the axis.

7. The circuit breaker handle connection structure of claim 1, wherein the handle disc portion further comprises a limiting-position buckle;

wherein the limiting-position buckle is configured to prevent counter-rotation of the lever about the axis, after the lever is rotated about the axis while the bottom is in the mounting recess.

8. The circuit breaker handle connection structure of claim 7, wherein the limiting-position buckle comprises two members that are rotationally symmetric about the axis.

9. The circuit breaker handle connection structure of claim 7, wherein a first end of the limiting-position buckle is fixedly connected to the handle disc portion, and the limiting-position buckle is configured to deform as a result of the rotation of the lever about the axis so that a second end of the limiting-position buckle is movable along the axis;

wherein the second end of the limiting-position buckle is configured to prevent the counter-rotation of the lever about the axis by engaging a side wall of the lever.

10. The circuit breaker handle connection structure of claim 9, wherein the second end of the limiting-position buckle comprises a protrusion along the axis.

* * * * *